US007967515B2

(12) United States Patent
Puigardeu et al.

(10) Patent No.: US 7,967,515 B2
(45) Date of Patent: Jun. 28, 2011

(54) PRINTER USING ROLL-BASED PRINT MEDIA AND METHOD OF LOADING PRINTER

(75) Inventors: Sergio Puigardeu, Barcelona (ES); Angel Martinez, Barcelona (ES); M. Isabel Borrell, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1056 days.

(21) Appl. No.: 11/790,840

(22) Filed: Apr. 27, 2007

(65) Prior Publication Data

US 2008/0267684 A1 Oct. 30, 2008

(51) Int. Cl.
*B41J 11/42* (2006.01)
*B41J 15/02* (2006.01)

(52) U.S. Cl. ..... 400/611; 347/37; 347/22; 226/2

(58) Field of Classification Search ..... 400/611; 347/37–39; 226/2, 3, 15, 45
See application file for complete search history.

(56) References Cited

U.S. PATENT DOCUMENTS 4,277,034 A 7/1981 Buzzell
4,486,093 A 12/1984 McNew
6,953,292 B2 * 10/2005 Menendez et al. ..... 400/70
7,011,400 B2 * 3/2006 Nakano ..... 347/101
2004/0160473 A1 * 8/2004 Lin ..... 347/22

FOREIGN PATENT DOCUMENTS

EP 0 805 042 11/1997
EP 0 805 043 11/1997
EP 0 901 975 3/1999
EP 1 479 526 11/2004
EP 1 674 259 6/2006

OTHER PUBLICATIONS

"Loading and Unloading Media," 38 Sheets. date unknown.
The TUP900 Series, The Complete Kiosk Printing Solution From Star Micronics, 2 Sheets, www.starmicronicseurope.com. date unknown.

* cited by examiner

*Primary Examiner* — Leslie J Evanisko

(57) ABSTRACT

A roll-based printer and method of loading the same. An example method includes sliding a roll of print media onto a print media spindle so that the roll of print media is positioned closer to a first end of the print media spindle than a second end of the print media spindle and loading the spindle onto a supporting assembly so that the spindle is rotatably supported by the supporting assembly and the first end of the print media spindle is at the end of the printer which is opposite to an end of the printer having a media detecting unit for detecting the presence of print media being fed to the printer. The example method includes feeding the print media to the printer from the loaded spindle, detecting the position of an edge of the print media fed to the printer and adjusting a starting position of the print head based on the detected position of an edge of the print media.

13 Claims, 7 Drawing Sheets

PRINTER USING ROLL-BASED PRINT MEDIA AND METHOD OF LOADING PRINTER

FIELD OF THE INVENTION

This invention relates to the field of printing, and more particularly to the field of printing using roll-based print media.

BACKGROUND

Printers such as inkjet printers which print onto a variety of print media such as paper or film are well known. As well as accepting print media in a single sheet format, some printers also accept print media fed from a supply roll of media that is supported by a roll-based apparatus. Such a printer may be typically referred to as a roll-based printer, being a printer that accepts roll-based print media. An example of such a roll-based printer is illustrated in FIG. 1.

The roll-based printer of FIG. 1 comprises a printing unit 10 having a print head (not visible) which is adapted to reciprocate along a scan axis assembly 12 within a housing 14. The printing unit 10 is supported on a framework 16 so that it is raised up from a floor or surface upon which the framework 16 is positioned. The framework 16 comprises a supporting assembly 18 (or roll-based apparatus) for rotatably supporting a supply roll of print media 20 such that print media may be fed from the supply roll 20 to the printing unit 10.

As with other conventional roll-based printers, the roll-based printer of FIG. 1 requires the supply roll of print media 20 to be loaded in a specific manner and orientation. More specifically, the supporting assembly 18 is designed to receive a first end 22 of a spindle 24 of the supply roll 20 at a first end "A" of the supporting assembly 18, before receiving a second opposing end 26 of the spindle 24 at a second end "B" of the supporting assembly 18.

Consequently, it is common for both experienced and beginner users to load the supply roll 20 onto the supporting assembly in the wrong orientation such that a feed direction of the supply roll 20 is not correct, thereby preventing the print media being fed to the printing unit 10.

If the supply roll 20 is loaded onto the supporting assembly incorrectly (i.e. in the wrong orientation), the user is required to unload the supply roll 20 from the supporting assembly 18, extract the roll of media 20 from the spindle 24, rotate the roll of media 20 to the correct orientation, and replace the roll of media 20 onto the spindle 24 before reloading the supply roll 20 onto the supporting assembly 18 again. Not only is this process undesirable and time-consuming for the user, but it also requires the user to lift and rotate a heavy roll of print media. For example, a typical roll-based printer may accept supply rolls that are 44 inches in length and weight in excess of 10 kg.

At present, no suitable solutions have been proposed which address the above problems associated with incorrect media loading of roll-based printers. Rather, attempts have been made to avoid the problems by prompting users to read an instruction manual prior to loading the printer. This, however, has proved to be ineffective, mainly for the reason that users do not typically take the time to read an instruction manual prior to using equipment.

Also, it is known to provide labels and/or images on the spindle and/or media roll which illustrate how the media roll should be loaded on to the spindle. An example of the illustrations used for such labels and/or images is provided in FIG. 2. It will be appreciated that the illustrations are very schematic and may be difficult for most users to understand at first glance.

It is therefore desirable to develop an improved method and/or arrangement for loading a roll-based printer with a supply roll of print media that addresses the problems associated with incorrect media loading. Preferably, the improved method and/or arrangement should enable a user to load a supply roll of print media irrespective of the orientation of the roll of print media on a spindle.

BRIEF DESCRIPTION OF THE DRAWINGS

For a better understanding of the invention, embodiments will now be described, purely by way of example, with reference to the accompanying drawings, in which.

DETAILED DESCRIPTION OF THE INVENTION

Figure 1:
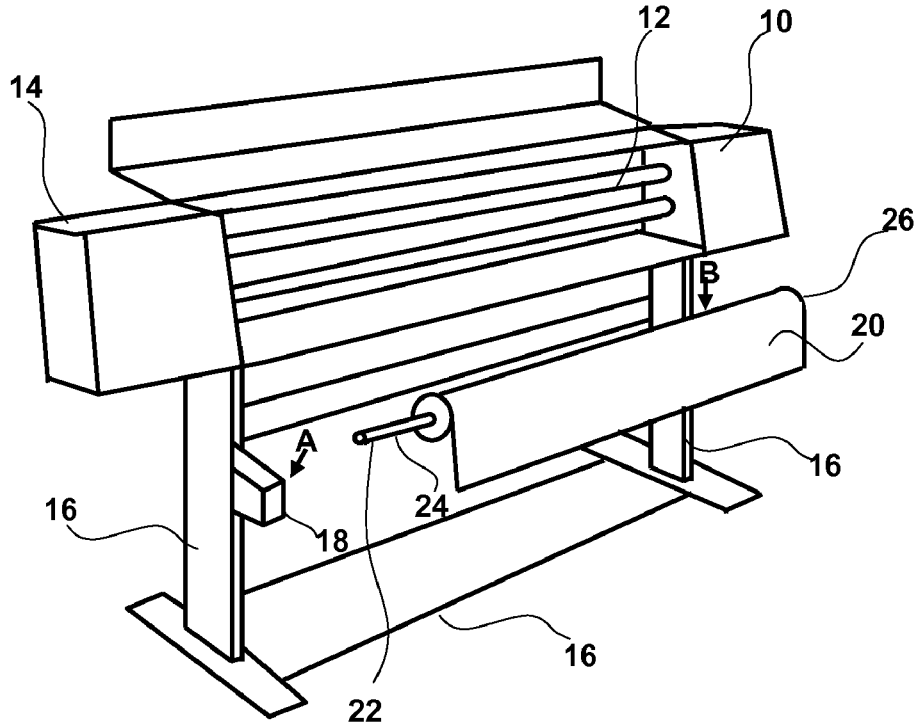
Figure 1 (PRIOR ART)
FIG. 1 is an illustration of a conventional roll-based printer.

While the present invention is susceptible of embodiment in various forms, there is shown in the drawings and described presently preferred embodiments. These embodiments are provided so that this disclosure will be thorough and complete, and will convey fully the scope of the invention to those skilled in the art. Like reference numerals refer to like elements throughout.

Figure 3:
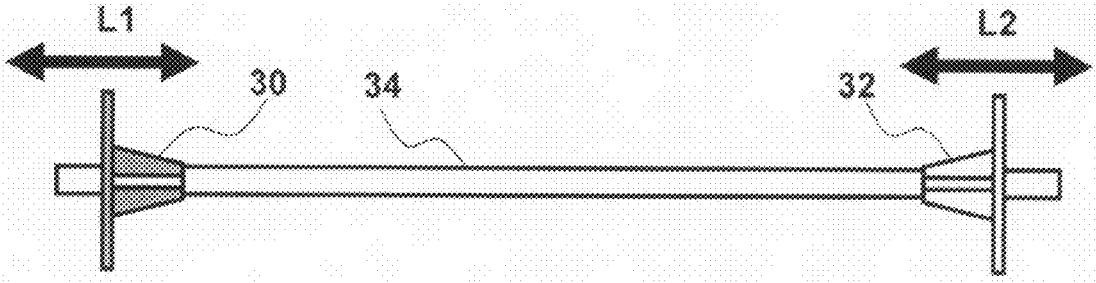
FIG. 3 shows a print media spindle according to an embodiment.

Referring to FIG. 3, a rigid spindle for receiving a roll of print media according to an embodiment of the invention comprises first 30 and second 32 retaining means at opposing ends of the spindle 34. For ease of understanding, the first retaining means 30 are shown as being darker in color than the second retaining means 32. This distinction should not be taken to imply that the first 30 and second 32 retaining means differ in terms of their technical features, but is instead used to simply aid illustration of the orientation of the spindle.

The first 30 and second 32 retaining means are adapted to retain a roll of media loaded onto the spindle 34 and positioned between the retaining means.

Further, the position of each of the first 30 and second 32 retaining means is adjustable along the longitudinal axis of the spindle 34, as indicated generally by arrows labeled "L1" and "L2", respectively.

The opposing ends of the spindle 34 are arranged to cooperate with a supporting assembly of a roll-based printer (not shown) so that the spindle 34 may be rotatably supported by the supporting assembly irrespective of the orientation of the spindle 34. In other words, the opposing ends of the spindle 34 are substantially identical such that it does not matter which end of the spindle 34 cooperates with a particular end of the supporting assembly.

In this way, if a roll of media is loaded onto the spindle 34 such that is it in the wrong orientation when the loaded spindle 34 is supported by the supporting assembly, the spindle 34 may simply be removed from the supporting assembly, rotated about an axis perpendicular to the longitudinal axis of the spindle, and then relocated on the supporting assembly so that the orientation of the loaded spindle 34 is reversed.

Thus, the invention allows a user to load a supply roll of print media into a roll-based printer regardless of the orientation of the media on the spindle. It does not require a user to extract a roll media from the spindle in order to correct the orientation of the media on the spindle. Instead, a user can leave the media on the spindle and simply reverse the orientation of the loaded spindle before relocating it in the supporting assembly of the printer.

Figure 4A:
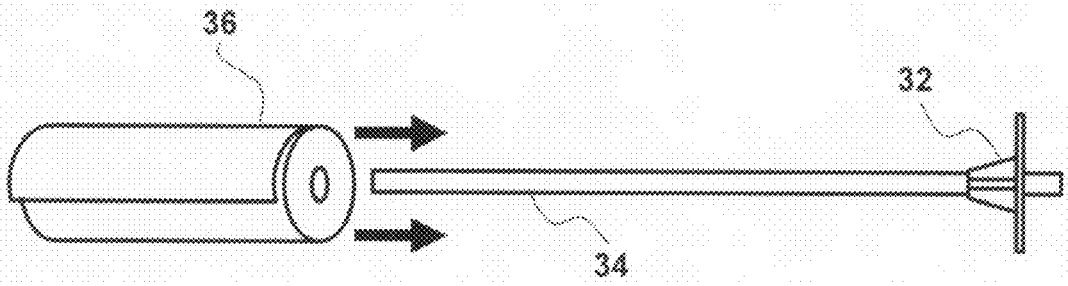
FIGS. 4*a* and 4*b* illustrate an exemplary method of loading the spindle of FIG. 3.
Figure 4B:
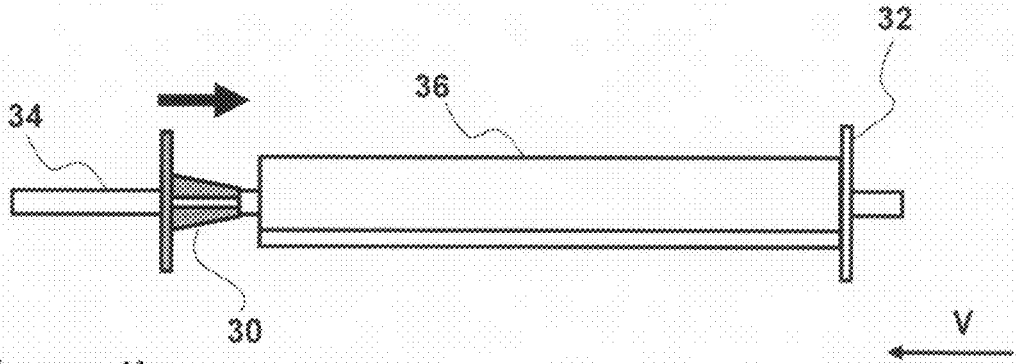

Referring to FIGS. 4*a* and 4*b*, an exemplary method of loading a spindle according to an embodiment of the invention will now be described.

Firstly, the first movable retaining means 30 is slid off the first (left) end of the spindle 34. A roll of print media 36 is then slid onto first (left) left end the spindle 34 (see FIG. 4*a*).

The roll of print media 36 is slid fully onto the spindle until its right-most end reaches the second retaining means 32 and it fits securely against the second retaining means 32 (see FIG. 4*b*). The first movable retaining means 30 is then slid back onto the first (left) end of the spindle 34 and located against the left-most end of the print media 36. Accordingly, the print media 36 is located on the spindle 36 and sandwiched between the first 30 and second 32 retaining means, thereby being ready to be loaded onto a supporting assembly of a roll-based printer.

From FIGS. 4*a* and 4*b*, it will be appreciated that the print media 36 has been loaded onto the spindle so that it unwinds from the spindle in an anti-clockwise direction when viewing the spindle from its second (right) end (as generally indicated by the arrow labeled "V"). If, when loaded onto a supporting assembly with the second (right) end of the spindle being supported by the right end of the assembly, the roll of media 36 is in the wrong orientation (i.e. it should instead unwind from the spindle in a clockwise direction when viewing the spindle from its second end), the user may simply reverse the orientation of the loaded spindle before relocating it in the supporting assembly. For a better understanding of this process, FIG. 5 illustrates how the orientation of a loaded spindle may be reversed.

Figure 5:
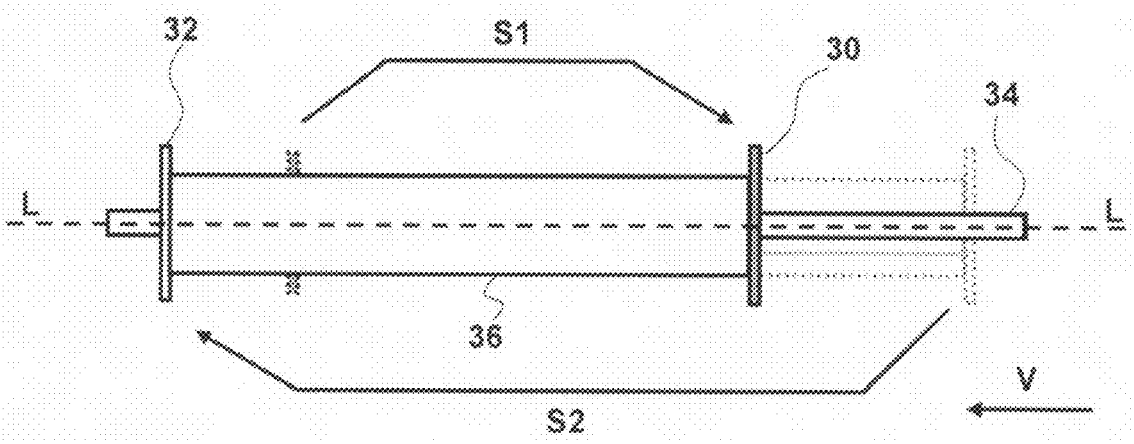
FIG. 5 illustrates how the orientation of a loaded spindle of FIG. 3 may be reversed.

As shown in FIG. 5, a loaded spindle 34 may be rotated about an axis perpendicular to the longitudinal axis (as indicated generally by the dashed line L-L) of the spindle so that the first (left) end of the spindle switches from left to right, and so that the second (right) end of the spindle switches from the right to left. Thus, the position of the first retaining means 30 switch from left to right, as indicated by the arrow labeled S1, and the position of the second retaining means 32 switches from right to left, as indicated by the arrow labeled S2. Accordingly, the media will then unwind from the spindle in a clockwise direction when viewing the spindle from its right-most end (as generally indicated by the arrow labeled "V").

Having reversed the orientation of the loaded spindle 34, it may then be relocated on the supporting assembly so that it is correctly oriented and the media 36 unwinds from the spindle 34 as required.

It will be understood that reversing the orientation of a loaded spindle may reverse the longitudinal position of the roll of media 36 relative to the supporting assembly. For example, the roll of media 36 is loaded onto the spindle 34 in FIG. 4*b* so that it is positioned towards the right-most end of the spindle 34.

Thus, when the orientation of the same loaded spindle 34 is reversed, as in FIG. 5, the position of the roll of media 36 on the spindle is switched to being at the left-most end of the spindle 34.

Figure 6:
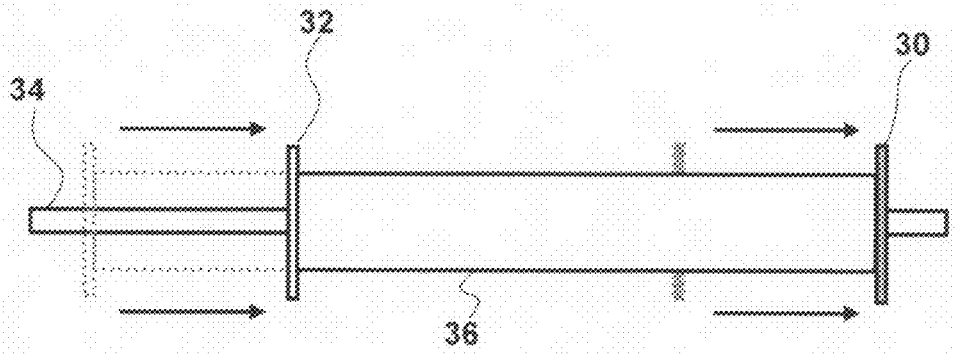
FIG. 6 illustrates how the longitudinal position of a roll of media on the spindle of FIG. 3 may be adjusted.

To accommodate such a variation in the longitudinal position of the roll of media 36 on the spindle 34, the position of each of the first 30 and second 32 retaining means can be adjusted along the longitudinal axis of the spindle 34, as illustrated in FIG. 6. Adjusting the position of the retaining means along the longitudinal axis of the spindle 34 enables the roll of media 36 to be positioned according to specific requirements of a printer without having to remove the roll of media 36 from the spindle 34, unlike conventional supply rolls for roll-based printers.

Thus, an embodiment is adapted to accommodate a variation in the longitudinal position of the roll of media 36 on the spindle 34 through the provision of a pair of retaining means 30 and 32 which can be adjusted along the longitudinal axis of the spindle 34. This enables the longitudinal position of the roll of media 36 on the spindle 34 to be adjusted as necessary without the roll of media 36 needing to be removed from the spindle 34.

Figure 2:
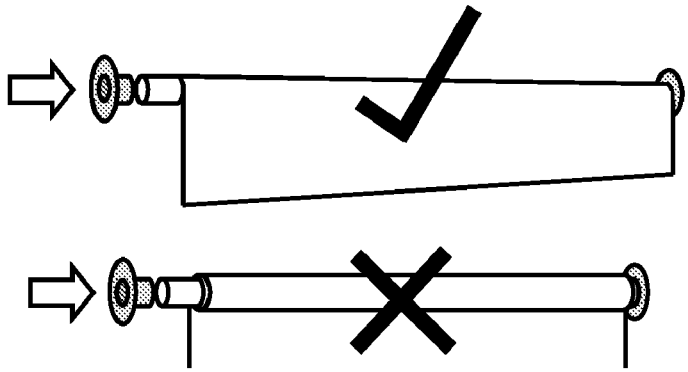
Figure 2 (PRIOR ART)
FIG. 2 shows exemplary illustrations which are used to explain how a media roll should be loaded on to a spindle for a convention roll-based printer.

An alternative embodiment does not require the spindle to comprise a pair of retaining means 30 and 32 which can be adjusted along the longitudinal axis of the spindle 34. Instead, a spindle having only one adjustable/removable retaining means (similar to the spindle of FIGS. 1 and 2) may be used with a roll-based printer which has detection means for detecting the position of the print media when it is fed to the printer from the supply roll. Based on the detected position, the printer may then adjust the starting or "home" position of the print head to accommodate for any positioning offsets that are present.

Figure 7:
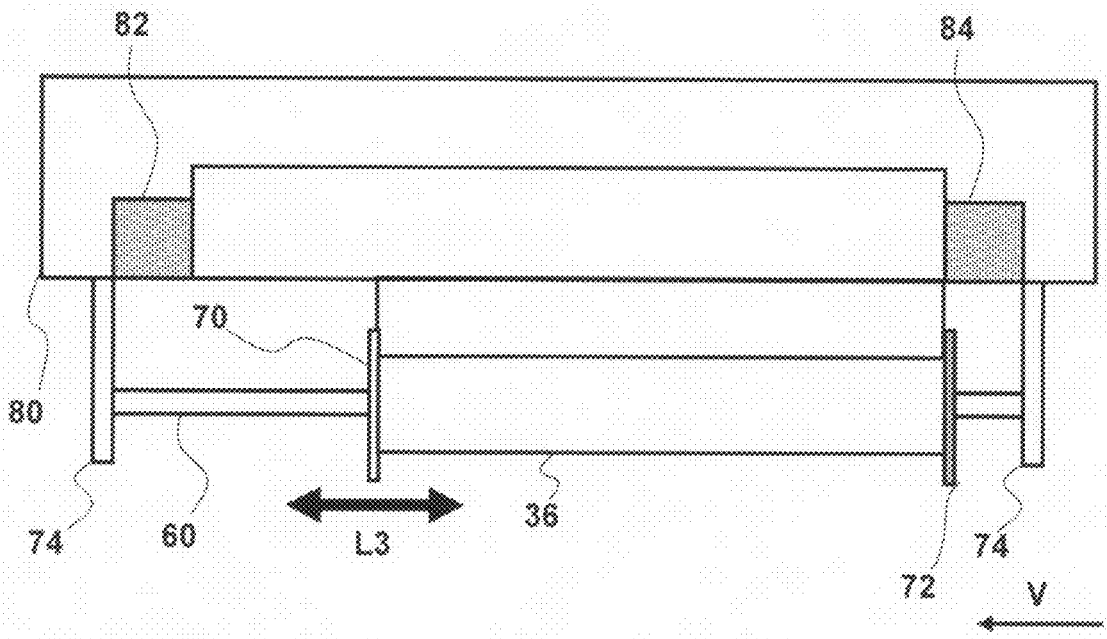
FIG. 7 shows a print spindle loaded onto a printer according to an embodiment of the invention, wherein the media is loaded in an incorrect orientation.

Referring to FIG. 7, a print spindle loaded onto a printer according to an embodiment will now be described, wherein the media is loaded in the incorrect orientation.

The rigid spindle 60 of FIG. 7 differs from that of FIGS. 3 to 6 in that only the position of the first retaining means 70 is adjustable along the longitudinal axis of the spindle 60 (as indicated generally by the arrow labeled "L3"). The second retaining means 72, situated at the opposite end of the spindle 60 to that of the first retaining means 70, is fixed to the spindle 60 and its position on the longitudinal axis of the spindle is not adjustable.

For ease of understanding, the first retaining means 70 are shown as being lighter in shade than the second retaining means 72. This distinction is used to simply aid illustration of the orientation of the spindle 60.

The first 70 and second 72 retaining means are adapted to retain a roll of media 36 loaded onto the spindle 60 and positioned between the retaining means.

The opposing ends of the spindle 60 cooperate with a supporting assembly 74 of a roll-based printer 80 so that the spindle 60 is rotatably supported by the supporting assembly 74 irrespective of the orientation of the spindle 60. In other words, the opposing ends of the spindle 60 are substantially identical such that it does not matter which end of the spindle 60 cooperates with a particular end of the supporting assembly 74.

The printer 80 comprises first 82 and second 84 print head maintenance units at opposing ends of the scan-axis of the printer 80. The first 82 and second 84 print head maintenance units are adapted to perform print head maintenance routines on the print head. Further, each of the print head maintenance units are also adapted to detect the position of the print media when it is fed to the printer from the supply roll and to accommodate for changes in media position along the longitudinal length of the spindle 60. Based on the detected position of the media on the spindle, the printer can adjust the starting or "home" position of the print head.

More specifically, the first 82 and second 84 print head maintenance units each comprise a lever under which print media may be fed. When the leading edge of the print media (i.e. the edge of the print media which is substantially parallel to the scan axis of the printer) passes under the lever, the media causes the lever to be lifted and/or activated. Thus, this activation or lifting of the lever may be used to detect the presence of print media.

By locating levers at opposite ends of the scan-axis, a position of print media along the scan axis of the printer can be determined based on which lever is activated when the print media is fed to the printer.

In this way, the print head can be controlled to return to (or stop at) an initial reference position near one end of the scan axis of the printer, where a print head maintenance unit is positioned. This reduces printing time by minimizing the distance the print head needs to travel to a print head maintenance unit to undergo maintenance.

Such an initial reference position may also be defined as a starting position of the print head, a starting position being a position at which the print head is located before it undergoes a printing pass.

For example, in the embodiment of FIG. 7, the spindle 60 is loaded onto the printer 80 such that the media is positioned at the right-most end of the scan axis, such that the second retaining means 72 are aligned with the second print head maintenance unit 84. Further, the print media 36 has been loaded onto the spindle 60 so that it unwinds from the spindle in an anti-clockwise direction when viewing the spindle from its second (right) end (as generally indicated by the arrow labeled "V"). For the printer of FIG. 7, this is in the wrong orientation (i.e. it should instead unwind from the spindle in a clockwise direction when viewing the spindle from its second end).

Thus, the user needs to simply reverse the orientation of the loaded spindle before relocating it in the supporting assembly. In other words, the user must rotate the spindle 60 about an axis perpendicular to the longitudinal axis of the spindle so that the first (left) end of the spindle switches from left to right, and so that the second (right) end of the spindle switches from the right to left, thereby reversing the orientation of the loaded spindle.

Figure 8:
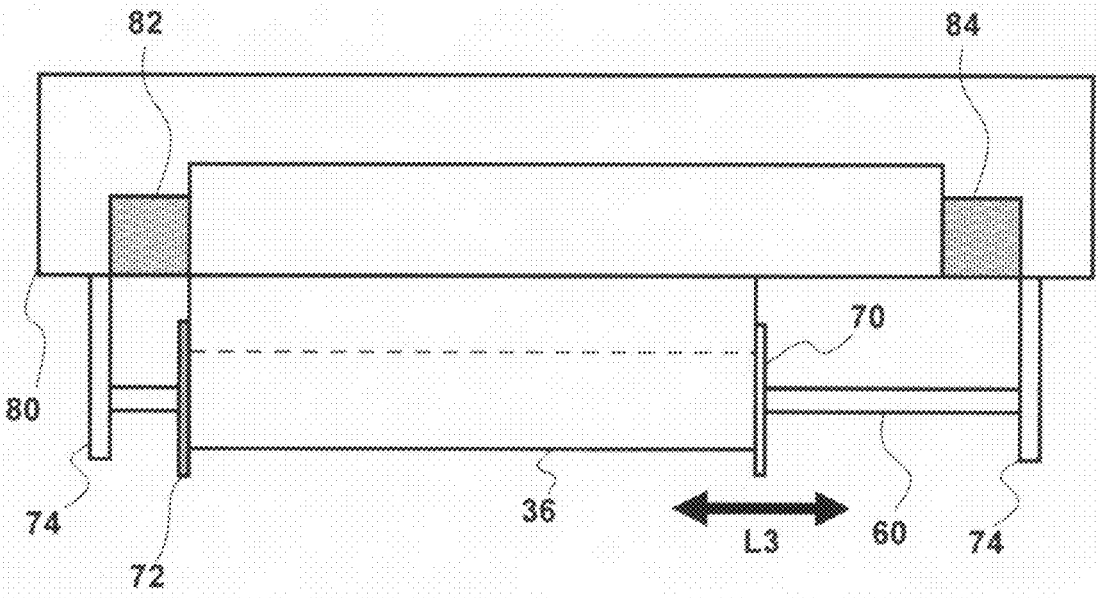
FIG. 8 shows the print spindle and printer of FIG. 7, wherein the orientation of the loaded spindle is reversed to be in a correct orientation.

Accordingly, the spindle 60 is then loaded onto the printer 80 with the position of media reversed to the left-most end of the scan axis (as shown in FIG. 8). The second retaining means 72 is therefore aligned with the first print head maintenance unit 82 and the print media is in the correct orientation (i.e. it unwinds from the spindle in a clockwise direction when viewing the spindle from its second (right) end. This reversed positioning of the media 36 is detected by the printer and the printer sets the home position of the print head to correspond with the left-most end of the scan axis (the end at which the first print head maintenance unit 82 is located). Thus, the printer 80 caters for the changed longitudinal position of the print media 36 on spindle where the second retaining means 72 is not adjustable (i.e. where the second retaining means 72 prevent the position of the print media 36 on the spindle 60 being changed).

An embodiment therefore allows a user to load a supply roll of print media into a roll-based printer regardless of the orientation of the media on the spindle.

Figure 9:
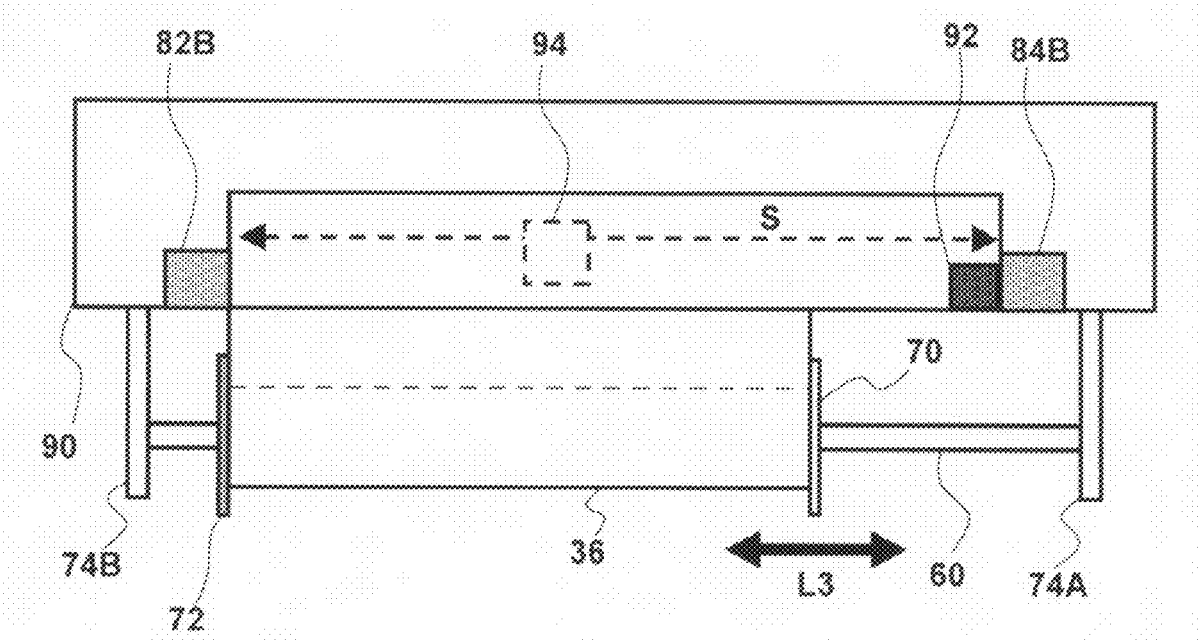
FIG. 9 shows a modification of the printer of FIG. 8.

Referring now to FIG. 9, a printer 90 according to another embodiment is shown. The printer 90 of FIG. 9 is similar to the printer 80 of FIG. 8. However, the printer 90 of FIG. 9 differs in that the first 82B and second 84B print head maintenance units of FIG. 9 are not adapted to detect the position of the print media when it is fed to the printer 90 from the supply roll 36. Instead, the printer 90 only comprises a single media detecting unit 92 located towards one end of the scan axis of the printer 90 and adapted to detect the presence of print media being fed to the printer 90.

More specifically, the media detecting unit 92 of FIG. 9 is a mechanical detector which is arranged to detect the presence of print media being fed to the printer. The media detecting unit 92 of this example is positioned at the right-most end of the scan-axis of the printer 90 and detects when a leading edge of the print media is to the right-most end of the scan-axis. In the situation illustrated by FIG. 9, although an end of the spindle 60 is loaded onto the right-most end 74A of the supporting assembly 74, the roll of media is not situated towards the right-most end of the spindle 60 since the first retaining means are not in contact with, or in close proximity to, the right-most end 74A of the supporting assembly 74. Thus, the media detecting unit 92 will not be activated by print media and the printer 90 may determine that the roll of media is located towards the left-most end of the spindle 60.

The printer 90 also comprises a media edge detecting unit 94 adapted to detect the position of an side edge (i.e. an edge of the print media which is substantially perpendicular to the scan-axis of the printer) of print media fed to the printer 90.The media edge detecting unit 94 is adapted to reciprocate along the scan axis of the printer (as indicated generally by the dashed arrowed labeled "S") in a similar fashion to the print head (not shown) of the printer 90. Of course, the media edge detecting unit 94 may be incorporated into (or with) the print head.

When a spindle 60 is loaded onto the supporting assembly 74 so that the end of the spindle having the roll of print media 36 is situated at the end of the printer 90 which is opposite to the end of the printer having the media detecting unit 92 (as is situation in FIG. 9), the media edge detecting unit 94 reciprocates along the scan axis S and detects the position of a side edge of the print media 36. For example, the media edge detecting unit 94 may comprise optical detection or sensing means that are adapted to sense optical properties as it moves along the scan axis S. A side edge of the print media may then be deduced by detecting a change in sensed optical properties.

Based on the detected position of an edge of the print media 36, the media edge detecting unit 94 can then cause the printer 90 to adjust a starting position of print head. When adjusting a starting position of print head, the printer 90 can also adjust other configuration settings and properties as may be necessary in view of the position of the media being fed to the printer. For example, the printer may modify a print head maintenance routine and/or change the printing speed (i.e. change the movement speed of the print head or the speed at which the media 36 is fed to the printer 90).

From the above description of exemplary embodiments of the invention, it will be appreciated that an improved method and/or arrangement for loading a roll-based printer with a supply roll of print media has been developed. Thus, the user can simply load a roll of media onto a spindle without worrying about the orientation of the roll. The user is not required to waste extra time and effort in extracting a roll of media from the spindle if the spindle is the loaded onto a printer such that it is in an incorrect orientation.

Figure 10:
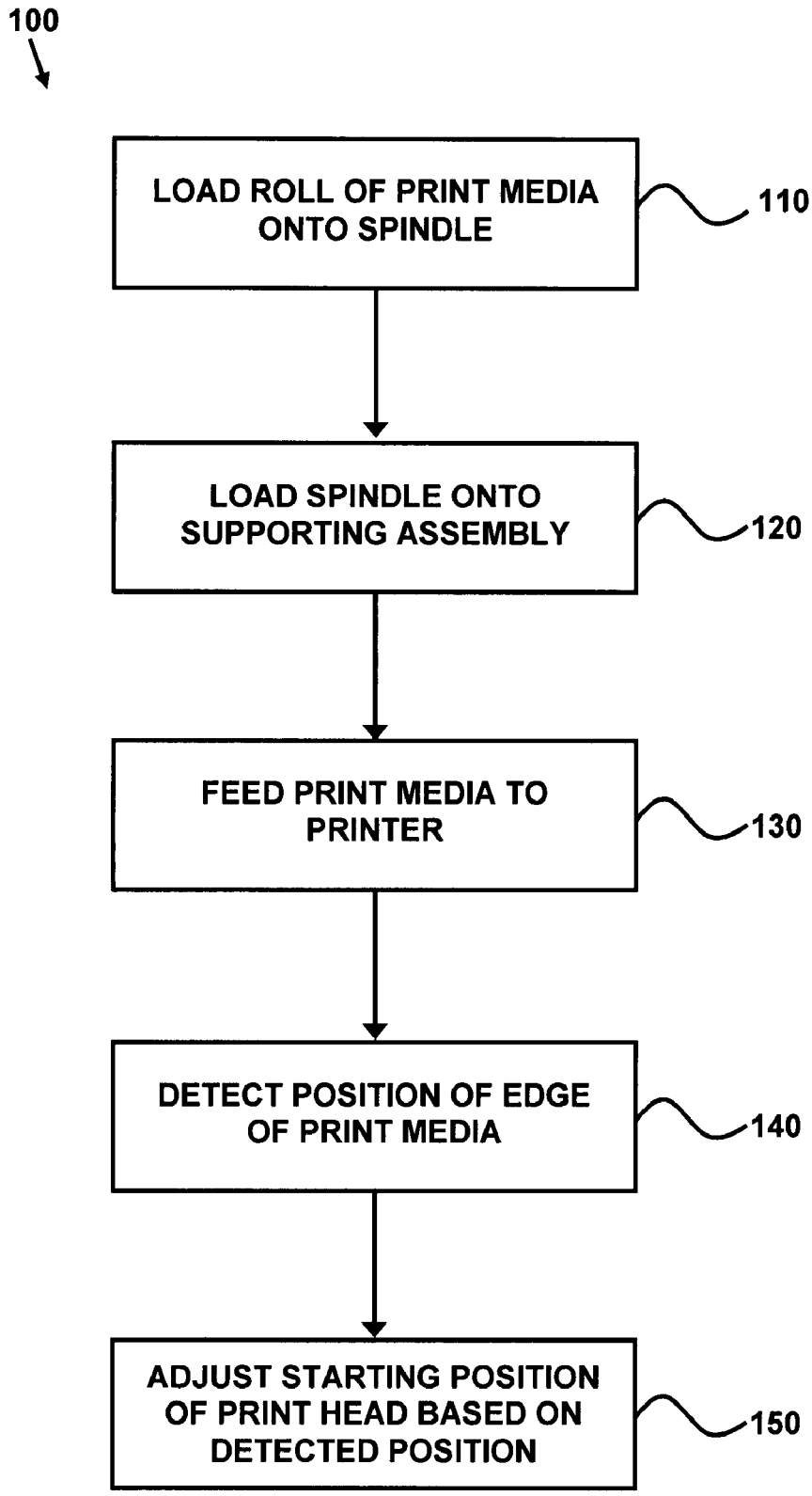
FIG. 10 is a flow diagram of a method of loading a roll-based printer according to an embodiment of the invention.

A method 100 of loading a roll-based printer according to an embodiment may therefore be represented by a flow diagram as shown in FIG. 10. Referring to FIG. 10, the method 100 begins with step 110, in which a roll of print media is slid onto a first end of a print media spindle. In other words, the roll of print media is situated such that more towards the first end of the print media spindle than the second end of the print media spindle, i.e. the roll of print media is not centrally located along the longitudinal length of the print media spindle. Thus, the middle of the roll of print media is closer to the first end of the spindle than the second end of the spindle, and the spindle may be said to be not symmetrically loaded.

After step 110 is completed, the spindle is loaded onto a supporting assembly in step 120. More specifically, the spindle is loaded on the supporting assembly so that the spindle is rotatably supported by the supporting assembly and the first end of the print media spindle is at the end of the printer which is opposite to the end of the printer having a media detecting unit. The method then proceeds to step 130.

In step 130, the print media is fed from the loaded spindle to the printer according to the specific feeding instructions of the printer.

Next, in step 140, the position of an edge of the print media fed to the printer is detected by a media edge detecting unit of the printer.

Based on the detected position of an edge of the print media, the printer then adjusts a starting position of the print head in step 150. In doing so, the printer changes one or more print head maintenance routines according to the detected position of an edge of the print media. Further, the printer adjusts the starting position of the print head by defining the end of the scan-axis to which the print head is to return after completing a printing pass.

Other modifications to settings, instructions, software, hardware and/or routines used by the printer may also be made based on the detected position of the print media, and such modifications will be apparent to the skilled reader.

Thus, embodiments of the invention address the problem of having to extract media from a spindle if it is loaded in an incorrect orientation. A first embodiment comprises a spindle having a pair of adjustable retaining means, thereby enabling the media to be slid along the spindle and realigned with the printer after the orientation of the spindle is reversed (i.e. the load spindle is flipped over). A second embodiment comprises detection means in a printer which are adapted to detect and cater for different positioning of media on a spindle, such change in positioning potentially being caused by reversing (flipping over) the loaded spindle.

It is envisaged that the invention is a particularly suitable for the field of large format printers, since the typical weight and size of rolls of print media for large format printing means that it undesirable for a user to have to extract a roll of print media from a spindle and replace the roll on the spindle in correct orientation.

For example, a roll of media for large format printing may be over 60 cm in length (measured from end-to-end along the longitudinal axis of the roll when rolled up) and have an unrolled length of 45 m, and may therefore weigh in excess of 3 kg. Further, a roll of super heavyweight matte paper for large format printing may be over 1.5 m in length (measured from end-to-end along the longitudinal axis of the roll when rolled up) and have an unrolled length of 30 m, weighing over 10 kg as a result.

While specific embodimentFs have been described herein for purposes of illustration, various modifications will be apparent to a person skilled in the art and may be made without departing from the scope of the invention.

We claim:

1. A method of loading a roll-based printer, the method comprising:

sliding a roll of print media onto a print media spindle so that the roll of print media is positioned closer to a first end of the print media spindle than a second end of the print media spindle;

sliding a retainer along the print media spindle to secure a longitudinal position of the print media on the print media spindle;

loading the print media spindle onto a supporting assembly so that the print media spindle is rotatably supported by the supporting assembly;

determining that the print media spindle is erroneously installed on the print media spindle in an orientation in which the print media is to unwind in an incorrect direction;

reversing an orientation of the print media spindle without removing the print media from the print media spindle;

feeding the print media to the printer from the loaded spindle;

detecting the position of an edge of the print media fed to the printer; and automatically adjusting a starting position of a print head of the printer based on the detected position of the edge of the print media.

2. A method according to claim 1, wherein adjusting the starting position of the print head comprises at least one of:

modifying a print head maintenance routine; and defining an end of a scan-axis to which the print head returns after completing a printing pass.

3. A method according to claim 1, further comprising adjusting a printing speed of the printer based upon the detected position of the edge of the print media.

4. A method according to claim 1, further comprising a media detecting unit having a mechanical detector to detect a leading edge of the print media.

5. A method according to claim 4, wherein the media detecting unit comprises an optical sensor and the media detecting unit is to detect a side edge of the print media by detecting a change in sensed optical properties.

6. A roll-based printer comprising:

a print head to reciprocate along a scan-axis of the printer;

a plurality of media detecting units spaced apart along the scan-axis of the printer, the media detecting units to detect the presence of print media fed to the printer from a spindle and to adjust a starting position of the print head based on a detected presence of the print media, the opposing ends of the spindle to cooperate with a supporting assembly to rotatably support the assembly irrespective of the orientation of the spindle; and a retainer slidable along the spindle to secure the print media adjacent a first end or a second end of the spindle such that, if the spindle is erroneously installed in the printer in a first orientation so that the media is to unwind in an incorrect direction, the spindle may be reversed and re-installed in the printer in a second orientation opposite the first orientation without removing the media from the spindle and the media detecting units are to automatically set a start position of the print head based on the re-installed position of the media.

7. A printer according to claim 6, further comprising a plurality of print head maintenance units spaced apart along the scan-axis of the printer, the print head maintenance units to perform one or more print head maintenance routines.

8. A printer according to claim 7, wherein the printer is to modify one or more print head maintenance routines based on the detected presence of the print media.

9. A printer according to claim 6 wherein the media detecting units comprise a mechanical detector to detect a leading edge of the print media.

10. A printer according to claim 6, further comprising a media edge detecting unit to detect the position of an edge of the print media fed to the printer, and the printer is to adjust the starting position of the print head based on a detected position of an edge of the print media.

11. A printer according to claim 10, wherein the media edge detecting unit comprises an optical sensor and the media edge detecting unit is to detect a side edge of the print media by detecting a change in sensed optical properties.

12. A printer according to claim 6, wherein the printer is to adjust its printing speed based upon the detected presence of the print media.

13. A printer according to claim 6, wherein the printer is a large format printer.

* * * * *